United States Patent [19]

Gryctko et al.

[11] 3,970,808

[45] July 20, 1976

[54] CIRCUIT INTERRUPTER HAVING ROTARY SWITCH OPERATOR AND INTERLOCKING STRUCTURE WITH TWO POSITION MOUNTING PLATE

[75] Inventors: Carl E. Gryctko, Haddon Heights, N.J.; Kenneth D. Ball, Warminster; Peter J. McGinnis, Chester Township, both of Pa.

[73] Assignee: I-T-E Imperial Corporation, Spring House, Pa.

[22] Filed: Oct. 15, 1974

[21] Appl. No.: 514,591

[52] U.S. Cl. ..... 200/50 A; 200/293; 200/330; 200/337

[51] Int. Cl.[2] ..... H01H 9/22; H01H 3/20; H01H 33/48

[58] Field of Search ..... 200/50 A, 330, 337, 200/153 R, 293

[56] References Cited

UNITED STATES PATENTS

| | | | |
|---|---|---|---|
| 2,849,555 | 8/1958 | Cellerini | 200/50 A |
| 3,313,896 | 4/1967 | Gray | 200/50 A |
| 3,324,259 | 6/1967 | Chamberlin, Jr. et al. | 200/50 A |
| 3,348,003 | 10/1967 | Mrenna | 200/50 A |
| 3,697,714 | 10/1972 | Gryctko et al. | 200/330 |

*Primary Examiner*—James R. Scott
*Attorney, Agent, or Firm*—Ostrolenk, Faber, Gerb & Soffen

[57] ABSTRACT

A rotary handle mechanism for operating a switch device secured to the rear wall of an enclosure is mounted separate from the enclosure cover and extends through a cover opening to be operable from outside of the enclosure when the cover is closed. The mechanism is designed so that the elements thereof may be assembled selectively for operation within an enclosure having a cover that is hinged along one or the other of its edges.

11 Claims, 15 Drawing Figures

FIG. 3
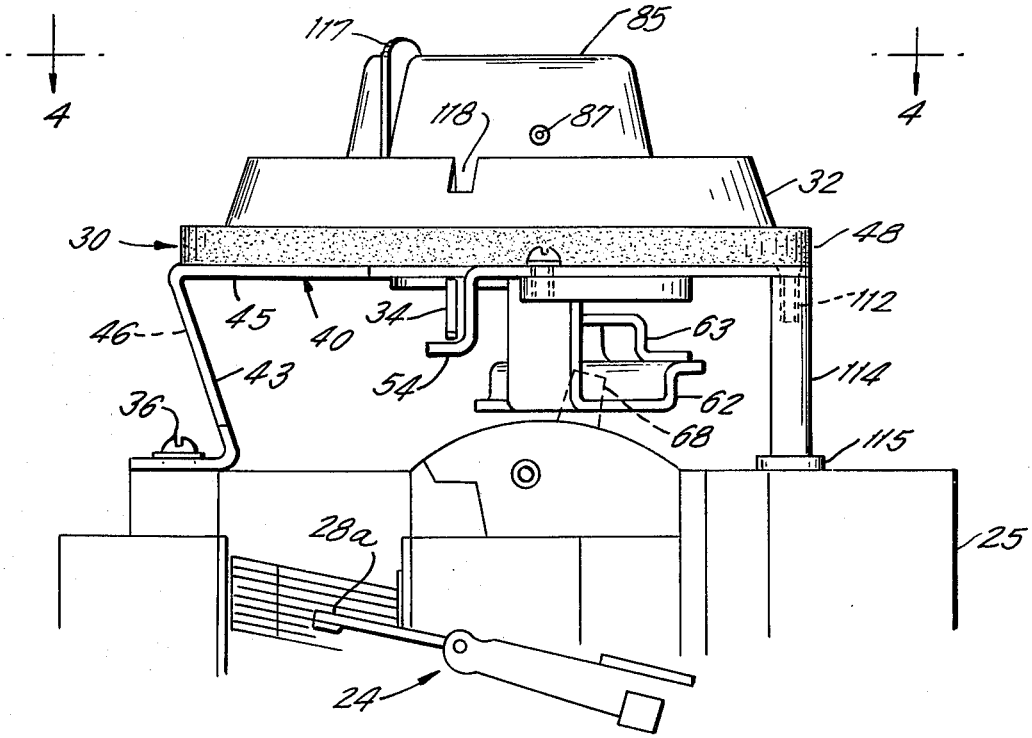
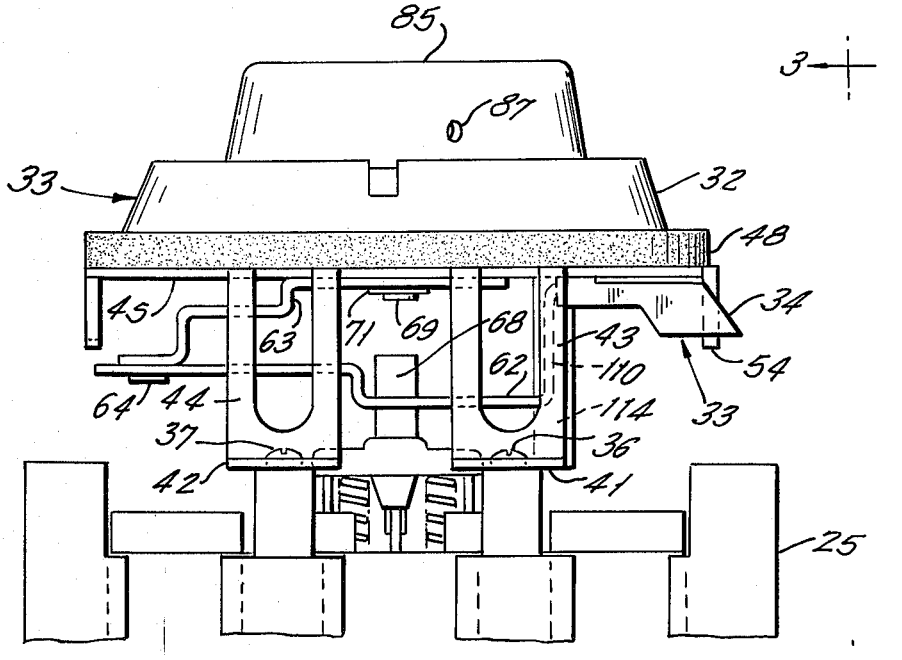
FIG. 2

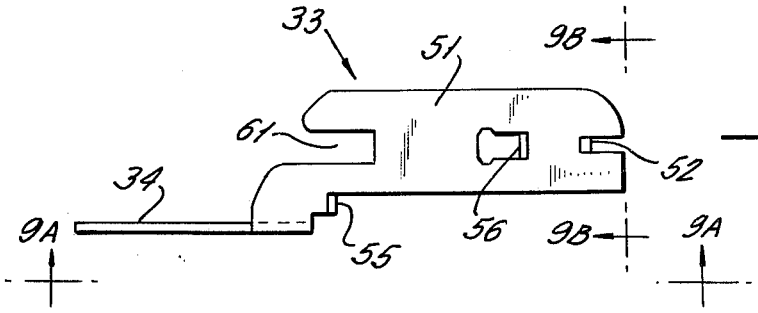
FIG. 9.
FIG. 9A.
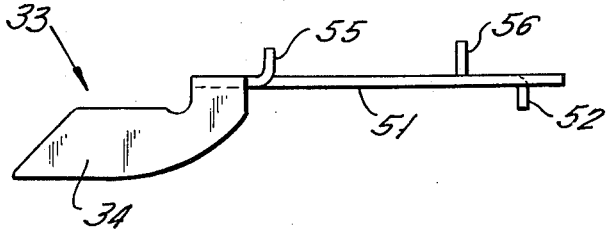
FIG. 9B.
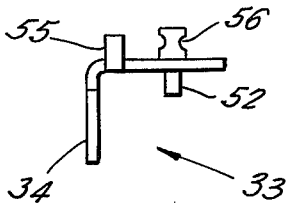
FIG. 10.
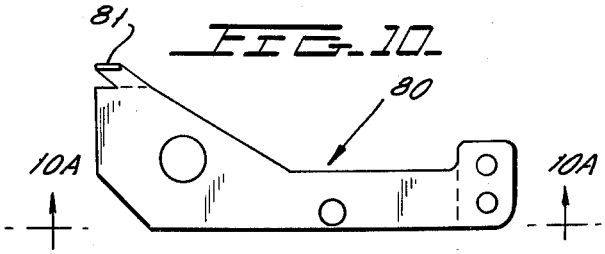
FIG. 11.
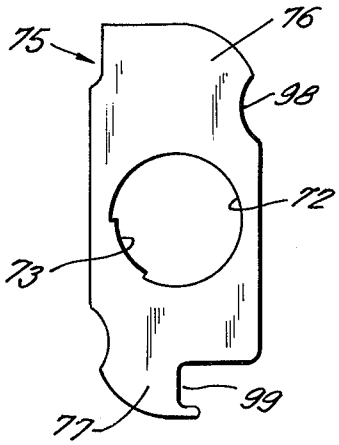
FIG. 10A.
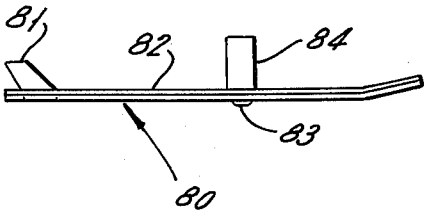

CIRCUIT INTERRUPTER HAVING ROTARY SWITCH OPERATOR AND INTERLOCKING STRUCTURE WITH TWO POSITION MOUNTING PLATE

This invention relates to handle mechanisms for operation of circuit interrupters enclosed in housings with the mechanisms being constructed for operation from outside the enclosure, and more particularly relates to handle mechanisms of this type that are readily constructed for use with covers hinged at opposite sides of the enclosure.

U.S. Pat. No. 3,697,714, issued Oct. 10, 1972, to Gryctko et al. for a Rotary Handle Operator With Reversible Cover Latch, illustrates a rotary handle mechanism mounted on a circuit interrupter disposed within an enclosure and mounted on the back wall thereof. The mechanism is so constructed that it includes a rear section having a mounting plate secured directly to the front of the circuit interrupter and a front section having a separate mounting plate that is in turn secured to the rear section and includes a rotary handle which extends through an opening in the enclosure cover when the latter is in its closed position, so that at that time the handle is operable from outside the enclosure.

A defeatable cover interlock is provided to prevent unauthorized persons from opening the enclosure cover when the circuit interrupter is closed and a defeatable switch interlock is provided to prevent accidental closing of the circuit interrupter when the enclosure cover is open. A handle locking means is provided to prevent unauthorized handle operation. The cover and switch interlocks include a common cam operated by the mechanism handle. In order to adapt for utilization of the mechanism with a cover that is hinged along either the right or left edge thereof, yet permit closing of the circuit interrupter by conventional clockwise handle rotation for either right or left side hinged covers, the front and rear sections of the mechanism are so constructed that they may be selectively mounted 180° apart.

In accordance with the instant invention, a rotary handle mechanism is constructed with a single mounting plate. Certain positioning formations of this mounting plate are constructed as mirror images of each other so that certain operating elements of the mechanism may be selectively mounted for operation with enclosure doors hinged along either side thereof. For economy the number of parts and assembly operations is reduced. The mounting plate is constructed with cutaway corner sections and with integrally formed legs so positioned that with the enclosure cover open the interrupter contacts are viewable even without moving the handle mechanism. A field installable auxiliary switch is adjustably mounted on the mounting plate.

Accordingly, a primary object of the instant invention is to provide a novel construction for a rotary handle mechanism used to operate a circuit interrupter mounted within an enclosure having an openable cover, with this handle mechanism extending outside of the cover.

Another object is to provide a rotary handle mechanism which is readily assembled for utilization with enclosures having either a left or a righthand side hinged cover.

A further object is to provide a mechanism of this type that includes adjustable field installable auxiliary switch means.

A still further object is to provide a mechanism of this type that is economical to manufacture because of reduced number of parts and simplicity of assembly.

These objects as well as other objects of this invention will become readily apparent after reading the following description of the accompanying drawings in which:

FIG. 1 is a perspective showing a fused circuit interrupter mounted within an enclosure having an openable cover, together with a rotary handle mechanism for interrupter operation being constructed in accordance with teachings of the instant invention.

FIG. 2 in a line end view of the handle mechanism, looking in the direction of arrows 2—2 of FIG. 1.

FIG. 3 is a fragmentary side elevation looking in the direction of arrows 3—3 of FIG. 2.

FIG. 9 is a front elevation of the cover latch.

FIGS. 9A and 9B are elevations of the cover latch looking in the directions of the respective pairs of arrows 9A–9A and 9B–9B of FIG. 9.

FIG. 10 is a front elevation of the switch interlock member.

FIG. 10A is an elevation of the switch interlock member looking in the direction of arrows 10A–10A of FIG. 10.

FIG. 11 is a front elevation of the rotary mechanism cam.

Figure 1:
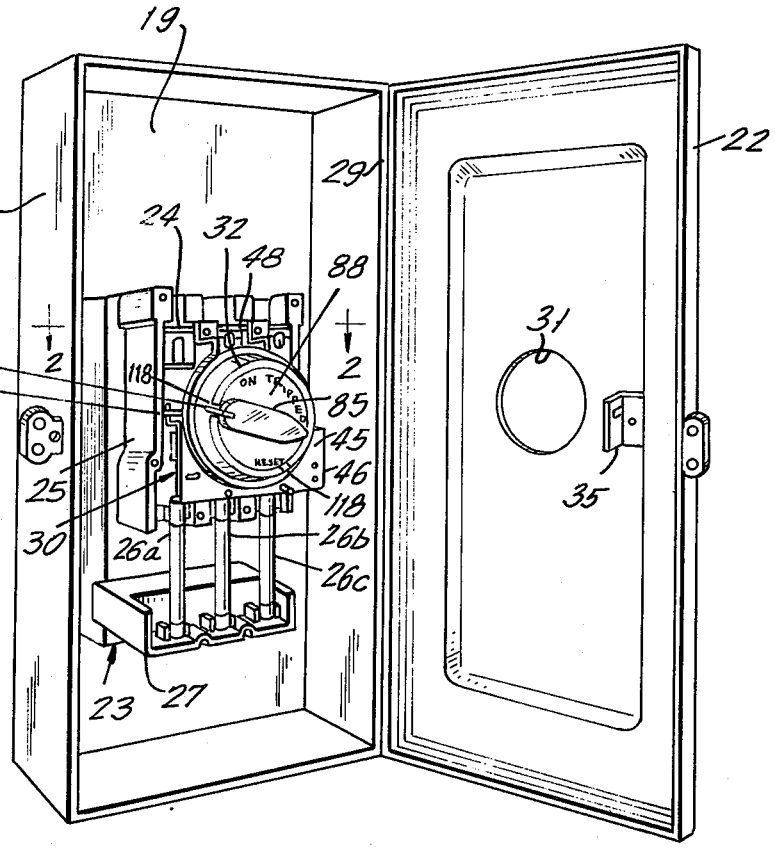

Now referring to the figures. The device of the instant invention is utilized in connection with rectangular sheet metal enclosure 21 (FIG. 1) having openable front cover 22 hingedly mounted to enclosure 21 along the forward right edge 29 thereof. Fused circuit interrupter 23 within enclosure 21 on rear wall 19 thereof is a three pole unit including switch 24 mounted on molded insulating base 25 and connected in electrical series with cartridge fuses 26*a*, 26*b*, 26*c*. The latter extend between one set of three clips mounted on insulator 25 and another set of three clips mounted on insulator 27.

Cover 22 is provided with circular cutout 31 through which ring 32 of rotary handle operator mechanism 30 extends when cover 22 is closed. At this time tip 34 of cover latch 33 engages cover mounted latching part 35 to normally lock cover 22 closed, so long as switch 24 is closed. As will hereinafter be seen, the contacts 28*a*, 28*b*, 28*c* of switch 24 are viewable when switch 24 and cover 22 are open without moving mechanism 30 from its operating position fixedly secured to the front of switch molding 25. This securement is achieved by screws 36, 37 (FIG. 4) that extend through clearance apertures 38, 39 in the outwardly projecting feet 41, 42 of rearwardly and inwardly extending legs 43, 44 formed integrally with main forward section 45 of the single mounting plate 40 of mechanism 30. Longitudinal cutouts 46, 47, extending from the forward ends of mounting legs 43, 44, provide clearances for the shaft of a screwdriver required to operate screws 36, 37. With cover 22 closed, the inner surface thereof engages and slightly deforms gasket 48 that is cemented to the forward surface of main section 45 which closely surrounds locking ring 32 to form a dust-tight closing for cover aperture 31.

Cover latch member 33 is constructed of a single piece of sheet stock and includes main section 51 disposed at right angles to latching part 34. Guide tab 52 at the end of main section 51 remote from latch 34 extends into guide slot 97 of plate 40, with main section 51 positioned forward of mounting plate 40 and latching tip 34 extending through guide slot 53 and being supported by rearwardly positioned foot 54 formed integrally with mounting plate 40 along one side thereof. A pair of tabs 55, 56 extend forwardly from main section 51 of cover interlock 33, with the tab 55 being positioned for engagement by cover latch defeater 60 pivotally mounted in bearing aperture 59 of mounting plate 40. Coiled tension spring 58 is secured at its opposite ends to tab 56 and forwardly extending post 57 formed integrally with mounting plate 40 to bias latch member 31 to the left, or latching direction, with respect to FIG. 1. Post 57 extends into cover latch slot 61 to cooperate therewith in guiding movement of member 33.

Figure 6:
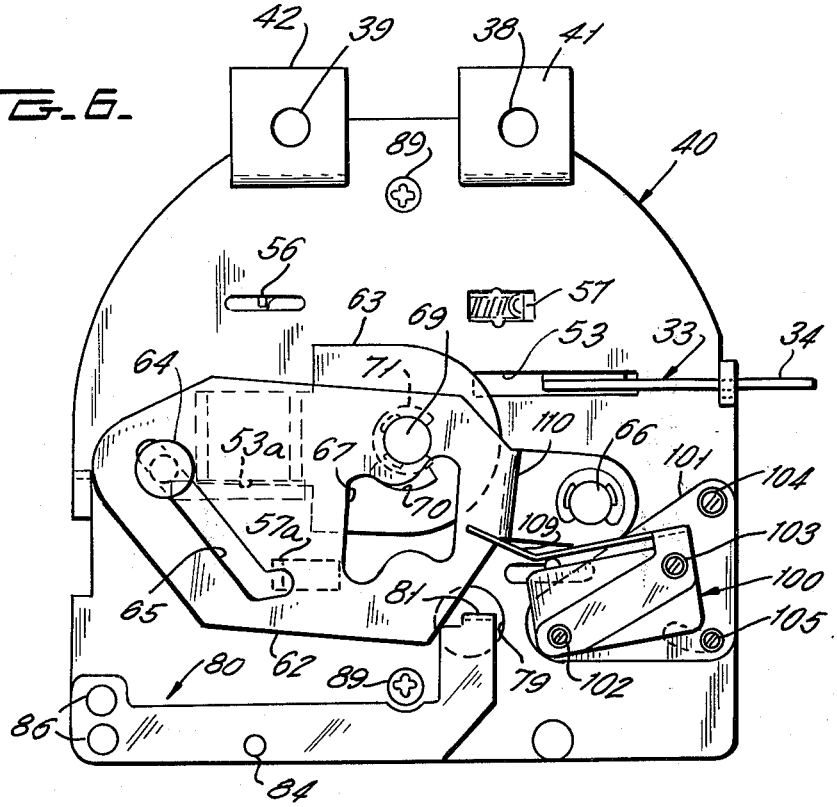
FIG. 6 is a rear elevation of the handle mechanism with an auxiliary switch mounted thereto.

Disposed to the rear of mounting plate main section 45 are main and intermediate cranks 62, 63 interconnected by pin 64 that rides in slot 65 (FIG. 6) of main crank 62. The end of main crank remote from slot 65 is offset forwardly and is pivotally connected to mounting plate 40 at bearing aperture 65a thereof by pin 66. The intermediate portion of main crank 62 is provided with aperture 67 that receives switch operating handle 68, so that limited pivotal movement of main crank 62 will cause opening and closing of switch 24 in a manner well known to the art. The end of intermediate crank 63 remote from pin 64 is keyed to the rear end of main shaft 69 by radial formation 70 and is maintained in operative position by spring retainer 71.

Main shaft 69 extends through bearing aperture 71 of mounting plate 40 and through aperture 72 of cam 75 (FIG. 11) being keyed to the latter at radial formation 73 of cam 75, which rides in arcuate depression 74 (FIG. 4) of shaft 69. Since depression 74 is slightly longer than keying formation 73, there will be limited pivotal movement of cam 75 relative to shaft 69.

Cam 75 rests against the forward surface of mounting plate 40, with cam end 76 extending between cover latch 31 and mounting plate 40. End 76 also extends between guide tab 52 and post 57. Thus, clockwise movement of shaft 69 causes cam end 76 to engage tab 52, moving cover latch 31 to the right with respect to FIG. 4 and unlatching tip 34 from cover latch 35. As this latter movement takes place, the opposite end 77 of cam 75 sweeps across forwardly extending projection 81 of switch interlock member 80 (FIG. 10), causing deflection of the latter. Extension 81 projects through mounting plate aperture 79 being biased forward because the main section 82 of switch interlock 80 is constructed of two sheets of spring metal secured together by peened end 83 of forwardly extending post 84 positioned intermediate the ends of main section 82. Rivets 86 at the end of main section 82 remote from locking projection 81 secure switch interlock 80 to the rear surface of mounting plate 40. When cover 22 is closed, the rear surface thereof engages post 84, driving it rearward thereby retracting locking tip 81 so that it moves out of the path of cam end 77, permitting cam 75 to be pivoted counterclockwise, and at the same time permitting counterclockwise pivoting of shaft 69 to bring about closing of switch 24 coupled thereto by crank 62, 63.

A rectangular depression (not shown) at the rear of operating handle 85 receives the squared forward end 188 of main shaft 69 to operatively connect handle 85 thereto. Shaft 69 and handle 85 are retained in their operative relationships by roll pin 78 (FIG. 3). Handle 85 is mounted directly in front of ON-OFF indicia carrying cover plate 88 that is secured to locking ring 32 by rivets (not shown) that extend through apertures **89*a*, 89*b* of cover plate 88. Cover plate 88 also includes aperture 90 which receives head 91 of defeater element 60 thereby acting as a second bearing for the latter, and central aperture 92 through which shaft 69 extends. Screws 89, 89 extend through apertures 190, 190 of mounting plate 40 and are threadably received by apertures (not shown) in the rear of ring 32 to secure the latter to the forward surface of mounting plate 40.**

Auxiliary switch 100 (FIG. 6) is secured to plastic mounting block 101 by screws 102, 103. Screws 104, 105 extending through the respective apertures 106, 107 of mounting plate 40, and operable from the front thereof, adjustably mount block 101 to plate 40. Aperture 107 is an arcuate slot which permits limited pivoting of mounting block 101 about aperture 106 as a center for adjustment of auxiliary switch 100 so that spring operator 109 thereof is correctly positioned for operation by stepped portion 110 of main crank 62, whereby the condition of switch 100, either open or closed as the case may be, is related to the position of switch handle 68.

Figure 7B:
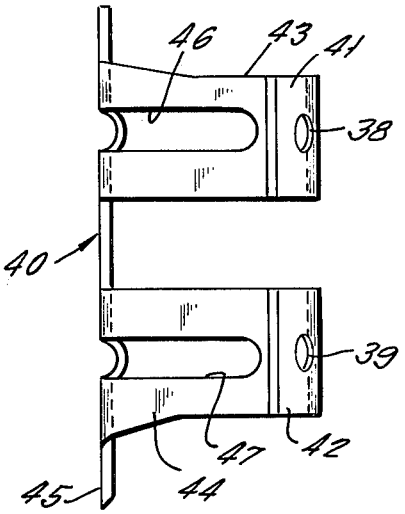
FIG. 7B is an end view of the mounting plate looking in the direction of arrows 7B—7B of FIG. 7A.
Figure 7:
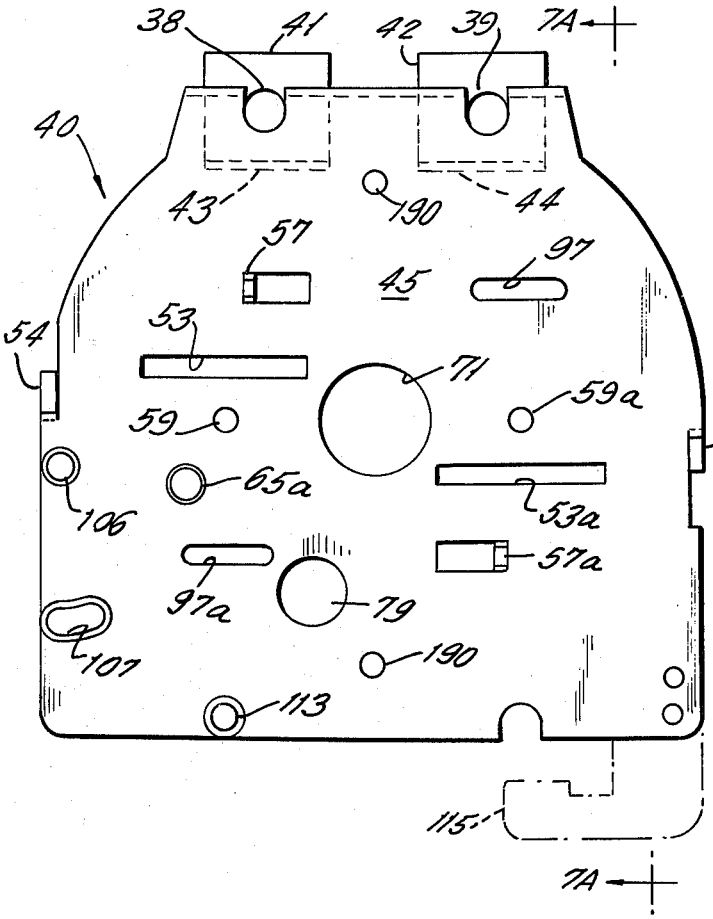
FIG. 7 is a front elevation of the single mounting plate of the rotary handle mechanism.
Figure 7A:
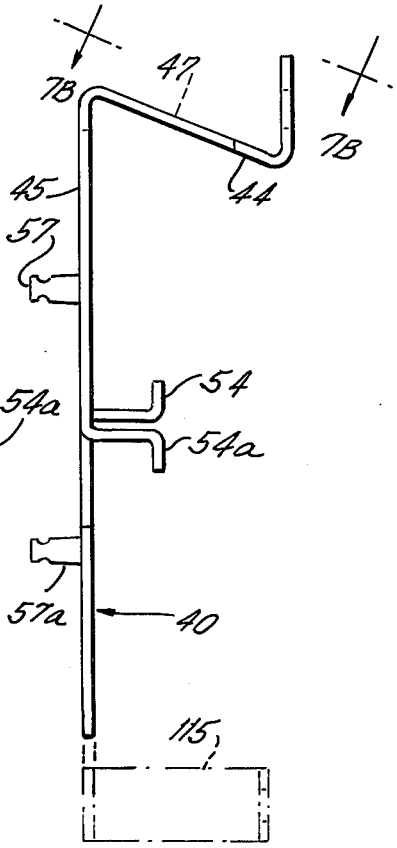
FIG. 7A is a side elevation of the mounting plate looking in the direction of arrows 7A—7A of FIG. 7.

Screw 112 extends through mounting plate aperture 113 to secure insulating post 114 at the rear of mounting plate 40, with the rear end of post 114 bearing against embossment 115 of switch molding 25 to support the end of support plate 40 opposite legs 43, 44. As an alternative to insulating leg 114, some applications will permit the utilization of metal support leg 115 (shown in phantom in FIGS. 7 and 7A) formed integrally with mounting plate 40. As a further modification, a separate metal leg similar to leg 115 may be utilized. This leg will be secured to mounting plate 40 by the same rivets 86, 86 that mount switch interlock member 80.

Locking slide 117 mounted to handle 85 cooperates with notches 118 in the forward edge of locking ring 32 to maintain handle 85 locked in a selected angular position in the manner explained in detail in the aforesaid U.S. Pat. No. 3,697,714.

It should now be apparent that rotary motion of operating handle 85 is transmitted through main shaft 69 and cranks 62, 63 to operate handle 68 of switch 24, with cranks 62, 63 being constructed to translate the rotary motion of handle 85 to essentially linear motion in a plane parallel to main section 45 of mounting plate 40. With switch 24 open and cover 22 open, switch interlock extension 81 projects forward of mounting plate 40, and at this time is in a blocking position relative to cam 75 preventing counterclockwise or interrupter closing movement thereof with respect to FIG. 4, in that with handle 85 in its closed position edge surface 99 of cam 75 is positioned to the left of extension 81. The closing of cover 22 causes the latter to engage post 84, driving it rearward to deflect switch interlock 80 and move extension 81 thereof out of the counterclockwise path of cam 75, thereby permitting handle 85 to operate switch 24 to its closed position.

With cover 22 closed, cover latching elements 34, 35 are in operative engagement. This engagement may be broken by utilizing a screwdriver to pivot defeater member 60 clockwise with respect to FIG. 4, thereby pivoting operator handle 85 clockwise. This, in turn, pivots cam 75 clockwise, with edge portion 98 thereof engaging tab 52 of cover interlock member 33, to move the latter to the right with respect to FIG. 4, thereby separating latch tip 34 from latch member 35.

Figure 4:
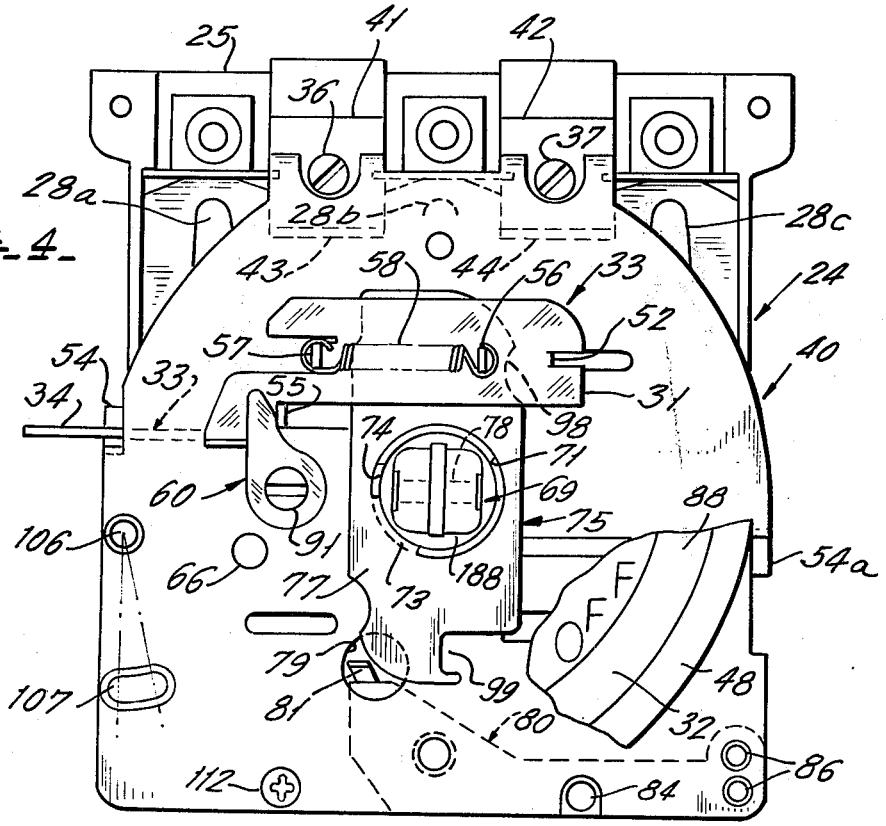
FIG. 4 is a front elevation looking in the direction of arrows 4—4 of FIG. 3, with portions of external elements being broken away to more clearly illustrate internal elements.
Figure 5:
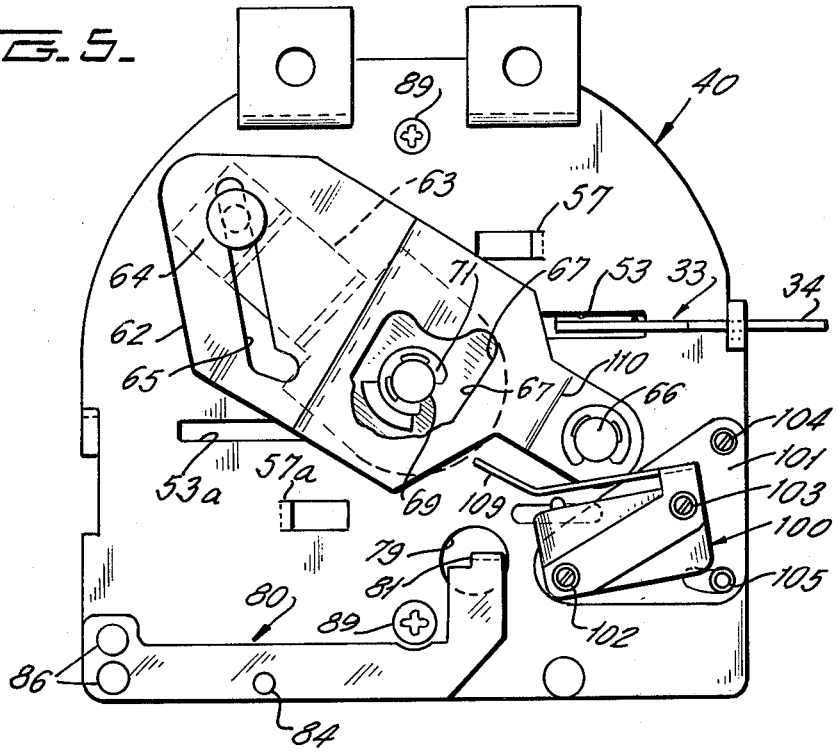
FIG. 5 is a rear elevation of the handle mechanism.
Figure 8:
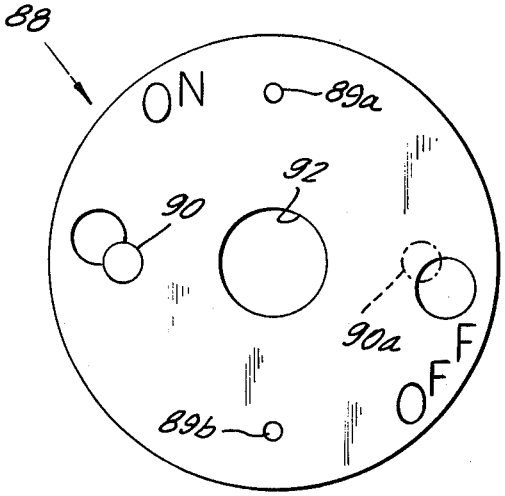
FIG. 8 is a front elevation of the rotary mechanism cover plate.

The only changes required of the operating mechanism hereinbefore described for utilization thereof with an enclosure cover pivoted at the left rather than the right is to provide a substitute for or modify cover plate 88 and to relocate defeater member 60, cover interlock member 33, and spring 58. More particularly, the substitute cover plate will have bearing aperture 80*a* and may or may not have bearing aperture 90 (FIG. 8) but the aperture will constitute one of the bearings for defeater member 60, which will be repositioned so that its other bearing will be provided by support plate aperture 59a. Cover latch member 33 will be repositioned so that cover latch portion 34 thereof extends through support plate slot 53a and is supported by rearwardly positioned foot 54a. Further, cover interlock member tab 52 will be disposed within guide slot 97a of support plate 40 and biasing spring 58 will be connected to support plate post 57a. In addition, cover mounted latch part 35 will be positioned near the cover edge opposite the hinge connection to the enclosure. With particular reference to FIG. 4, it is seen that the end of cover plate 40 having mounting legs 43, 44 is cut away at both corners thereof so that with cover 22 open it can be readily observed visually whether movable contacts 28*a* and 28*c* of the outer poles are in their open positions. This observation may also conveniently be made of the center pole movable contact 28b because of the generous spacing between legs 43, 44 and the spacing between mounting plate main portion 45 and the front of molding 25.

Although there have been described preferred embodiments of this novel invention, many variations and modifications will now become apparent to those skilled in the art. Therefore, this invention is to be limited not by the specific disclosure herein but only by the appending claims.

The embodiments in which an exclusive privelege or property is claimed are defined as follows.

1. In combination, an enclosure having a first side normally closed by an openable front cover; a circuit interrupter within said enclosure and having a handle disposed entirely within said enclosure; an operator mechanism separate from said cover for manually operating said circuit interrupter from a point outside of said enclosure and in front of said cover; said mechanism including a single mounting plate fixedly mounted to said interrupter, a crank means positioned at the rear of said plate and operatively connected to said handle, an operating handle disposed in front of said plate in operative position received by an aperture in said cover as the latter moves from its open to its closed position, a main shaft connecting said operating handle to said crank means whereby pivotal movement of said operating handle in a plane parallel to said cover in its said closed position is effective to operate said crank means which in turn operates said handle, a first element biased to cover latching position for maintaining said cover closed, a second element biased to blocking position, cam means operable by said operating handle to move said first element to cover releasing position, said cam means and said second element in said blocking position cooperating to prevent operation of said operating handle to close said circuit interrupter when said front cover is open, interlock means operable by said cover upon closing thereof to move said second element from said blocking position to a retracted position wherein said operating handle may be operated to close said circuit interrupter, defeater means for moving said first element to said cover releasing position when said circuit interrupter is closed, an indicia carrying plate behind said operating handle and cooperating therewith to indicate the position of said handle; said mounting plate including a first set of formations operatively positioning said first element, said second element, said interlock means and said defeater means on said mounting plate in combination for use of said mechanism with said cover hinged along a first edge of said enclosure; said mounting plate also including a second set of formations defining alternate operative positions on said mounting plate for said first element and said defeater means; with said first element and said defeater means in said alternate positions said mechanism being usable with a cover hinged along a second edge of said enclosure opposite to said first edge.

2. The combination as set forth in claim 1 in which the mounting plate includes first and second integrally formed rearwardly extending legs at one end thereof; said legs being slanted inward and at their forward ends having outward feet for mechanical securement of the operating mechanism to the circuit interrupter.

3. The combination as set forth in claim 2 in which the corners of said mounting plate at said one end are cut away to facilitate visual examination of contact means separations of said interrupter without repositioning said operating handle relative to said handle.

4. The combination as set forth in claim 2 in which said interrupter includes a plurality of fuses mounted at an end of said operating mechanism and positioned for mounting and dismounting without repositioning said operating handle relative to said handle.

5. The combination as set forth in claim 4 in which the mounting plate includes first and second integrally formed rearwardly extending legs at one end thereof; said legs being slanted inward and at their forward ends having outward feet for mechanical securement of the operating mechanism to the circuit interrupter; said one end being opposite said end.

6. The combination as set forth in claim 5 in which the corners of said mounting plate at said one end are cut away to facilitate visual examination of contact means separations of said interrupter without repositioning said operating handle relative to said handle.

7. The combination as set forth in claim 2 also including an insulating post secured to said mounting plate at the other end thereof; said post extending to the rear of said mounting plate and engaging said interrupter to maintain clearance at said other end between said mounting plate and said interrupter.

8. The combination as set forth in claim 1 also including auxiliary switch means, securing means adjustably mounting said auxiliary switch to said mounting plate at the rear thereof in operative position for operation by said crank means.

9. The combination as set forth in claim 8 in which the securing means is operable from in front of the mounting plate when the cover is open.

10. The combination as set forth in claim 9 in which the mounting plate includes first and second integrally formed rearwardly extending legs at one end thereof; said legs being slanted inward and at their forward ends having outward feet for mechanical securement of the operating mechanism to the circuit interrupter; at said one end said mounting plate having its corners cut away to facilitate visual examination of contact means separations of said interrupter without repositioning said operating handle relative to said handle.

11. The combination as set forth in claim 1 in which the mounting plate is provided with integrally formed rearwardly positioned foot means operatively supporting the first element by engaging the latter at a point in the region where said first element engages said cover.

* * * * *